United States Patent [19]

Sato

[11] 4,051,780

[45] Oct. 4, 1977

[54] LABEL FEED MECHANISM FOR PORTABLE LABELING MACHINES

[75] Inventor: Yo Sato, Tokyo, Japan

[73] Assignee: Kabushiki Kaisha Sato Kenkyusho, Tokyo, Japan

[21] Appl. No.: 686,562

[22] Filed: May 14, 1976

[30] Foreign Application Priority Data

May 15, 1975 Japan ..... 50-054308

[51] Int. Cl.[2] ..... B41F 1/08; B41J 1/08; B41J 1/40

[52] U.S. Cl. ..... 101/305; 101/291; 101/298

[58] Field of Search ..... 101/287-296, 101/297-305; 156/384, 387

[56] References Cited

U.S. PATENT DOCUMENTS

| | | | |
|---|---|---|---|
| 1,837,622 | 12/1931 | Lumpkin | 101/291 |
| 2,584,195 | 2/1952 | Evans | 101/288 X |
| 3,116,686 | 1/1964 | Dudley | 101/291 X |
| 3,440,123 | 4/1969 | Hamisch, Sr. | 101/288 X |
| 3,522,131 | 7/1970 | Yo Sato et al. | 101/288 |
| 3,611,929 | 10/1971 | Schrotz et al. | 101/292 |
| 3,705,833 | 12/1972 | Wada | 101/288 X |
| 3,782,279 | 1/1974 | Carboni, Jr. | 101/288 |
| 3,800,701 | 4/1974 | Martin | 101/288 |
| 3,911,817 | 10/1975 | Becker et al. | 101/288 |

*Primary Examiner*—Russell R. Kinsey
*Assistant Examiner*—Paul J. Hirsch
*Attorney, Agent, or Firm*—Ostrolenk Faber Gerb & Soffen

[57] ABSTRACT

A feed mechanism for feeding an elongated strip of labels in a portable labeling machine. The label feed mechanism intermittently advances the label strip with an indexed movement in response to the manual gripping and releasing of a grip lever which acts through an actuating member that is pivotally connected to the grip lever. The label feed mechanism includes a rotatable feed wheel, and it includes a drive member which is connected to the actuating member at a position far from the pivot of the actuating member. The drive member may be a combination of a ratchet lever on the actuating member and a ratchet wheel connected to the feed wheel or it may be a combination of a rack on the actuating member and a pinion on the feed wheel. Between the ratchet wheel or the pinion and the feed wheel is a gear assembly that amplifies motion of the ratchet wheel or pinion. Thus, the manual actions of the grip lever are amplified in the motion of the feed wheel to ensure an elongated advancing motion of the label strip.

9 Claims, 6 Drawing Figures

LABEL FEED MECHANISM FOR PORTABLE LABELING MACHINES

BACKGROUND OF THE INVENTION

1. Field of the Invention

The present invention relates to a portable label applying machine, and particularly to a label strip feed mechanism for such a machine. Such a machine feeds a strip of labels through its housing, prints on individual labels of a continuous label strip, separates individual labels from the elongated strip and sometimes applies the labels to items to be labeled. A label strip is comprised of a continuous strip of backing paper ordinarily having a layer of a parting agent, such as silicone, applied to a surface of the backing paper and of a row of same size labels adhered in end-to-end relationship to the surface of the backing paper. The undivided labels are printed, fed to an outlet and peeled one by one from the backing paper. The peeled labels are individually applied to successive articles.

2. Description of the Prior Art

It is desirable to apply a variety of information about a commodity, including the price, the name and address of a shop, the name, content and production date of the commodity, as well as other symbols upon a label to be applied to the surface of that commodity. In order to tabulate all of this information to enable easy observation, it is the current practice to enlarge the label without changing or reducing the size of the symbols being printed. It becomes necessary for the distance over which a label strip is advanced upon dispensing of a single label to be increased accordingly as the size of an individual label is enlarged.

Portable labeling machines of the above type include a feed wheel that is rotated by the gripping and releasing of a manual grip lever. The continuous label strip is engaged by the feed wheel, and most usually by the outer periphery of the wheel, and the strip is advanced by the rotation of the feed wheel.

The most suitable angular stroke for the gripping motion of the grip lever, from the standpoint of human engineering, has been found to be substantially 18°. The angular stroke of the grip lever is usually preset at an angle of at most 18°. This places a restriction upon the length of the portion of the continuous label strip that is to be fed by a single cycle of gripping and releasing of the grip lever. Obviously, as the angle of the gripping stroke of the grip lever is increased, the distance of the movement of said lever is accordingly enlarged. The angle of rotation of the feed wheel is correspondingly enlarged. But increasing the angle of the grip lever increases the difficulty of the gripping action of the hand lever. If the manual gripping action is made easier, the stroke of the grip lever is reduced and the length of the portion of the label strip that is fed during one grip lever stroke is accordingly reduced.

SUMMARY OF THE INVENTION

It is the primary object of the present invention to provide an improved label feed mechanism for use in a portable labeling machine.

It is another object of the invention to provide a label feed mechanism that is free from the difficulties experienced with conventional label feed mechanisms.

Another object of the present invention is to provide an improved label feed mechanism which causes a continuous label strip to move a desired feed distance.

It is a further object of the invention to properly feed and index a label strip having labels of relatively large size without enlarging the diameter of the feed wheel nor the gripping angle of the grip lever.

All embodiments of the invention provide an improved label feed mechanism for intermittently advancing the elongated label strip with an indexed movement in response to the motion of the manual grip lever, which moves the yoke attached to the grip lever. The label feed mechanism includes a rotatable feed wheel which has a plurality of advancing teeth formed preferably on its outer periphery. The teeth are sized and arranged to engage in transverse cuts formed at spaced intervals along the label strip. A driven gear is connected with and is rotatable with the feed wheel. A feed wheel drive member is connected to the yokes at a position spaced from the pivot of the yokes. This drive member operatively engages a drive gear assembly which, in turn, engages the coacting driven gear for rotating it. This rotates the feed wheel to move the label strip.

In one embodiment of the present invention, the driven gear is supported to rotate together with a label strip feed wheel. The drive member comprises a ratchet lever pivotally connected at one end to the yokes. The other end of the ratchet lever engages a ratchet wheel which is the initial part of the drive gear assembly and is the drivable element thereof. The angle through which the feed wheel rotates during a single action of the hand grip lever is determined by the combined operations of the ratchet lever that translates generally lengthwise in response to the movement of the grip lever, the ratchet wheel that is engaged by and rotated by the ratchet lever and a drive gear assembly for transmitting the rotational motion of the ratchet wheel to the coacting driven gear. Adjusting the gear ratios of the various engaging gears determines the extent to which the feed wheel will rotate upon one gripping stroke of the grip lever.

In another embodiment of the present invention, the drive member comprises a toothed rack attached, immovably, to the yokes at a location spaced from the pivot of the yokes. The initial part of the drive gear assembly, i.e., its drivable element, comprises a rotatable pinion in engagement with the rack, which is to be rotated by translational movement of the rack. The drive gear assembly transmits rotation of the pinion to the driven gear. Adjusting the gear ratios has the same result as in the first embodiment.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENTS

Figure 1:
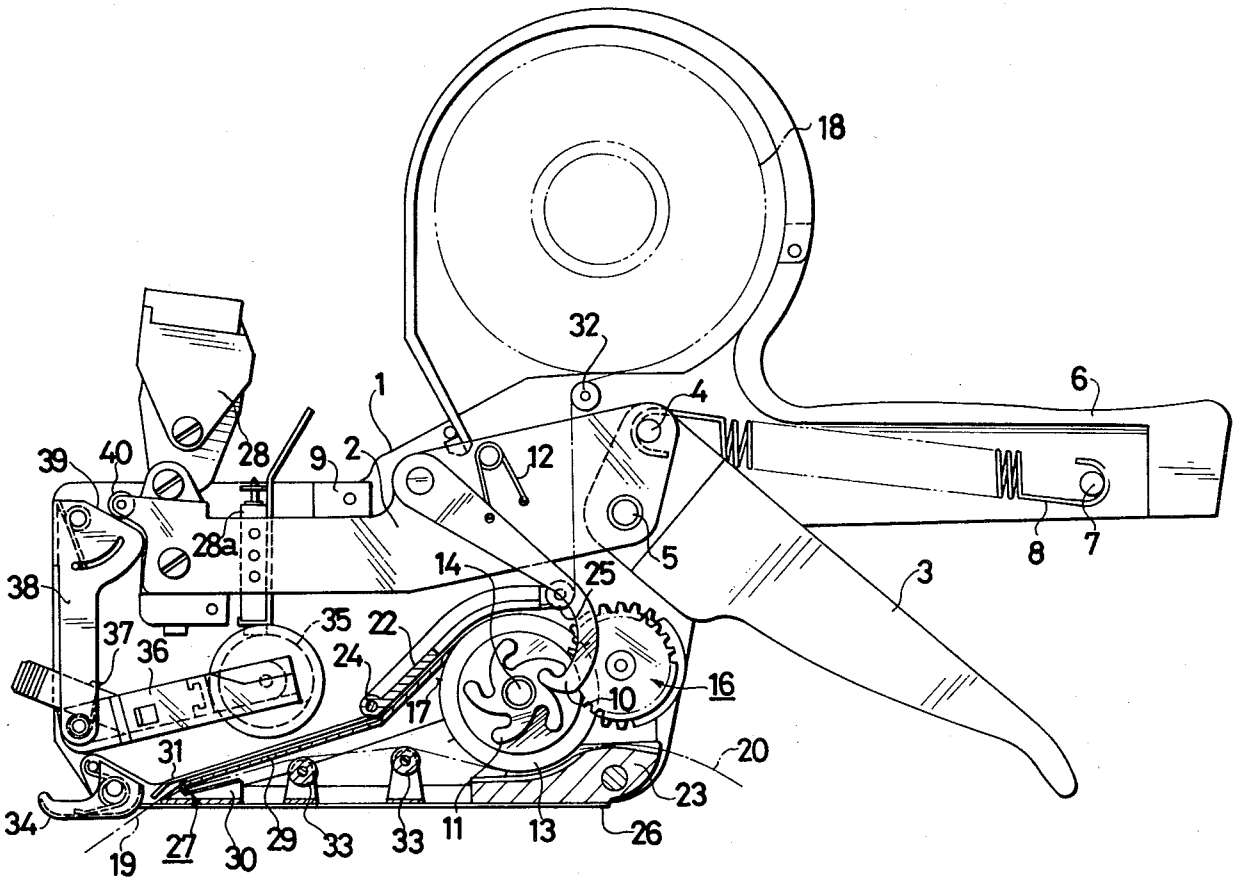
FIG. 1 is a side elevational cross-sectional view showing a portable labeling machine, in which a label feed mechanism according to the present invention is incorporated.

Referring to the accompanying drawings, the present invention will be described in conjunction with two of its embodiments. In FIG. 1 is shown a portable labeling machine. It includes a frame 1. At the upper portion of and extending along opposite sides of frame 1 are disposed a pair of movable yokes 2, which are juxtaposed to each other. A manually operable hand grip lever 3 is provided. Yokes 2 are pivotally connected to one of their ends to an end portion of the hand grip lever 3 by means of a pivot pin 4. That end portion of the grip lever 3 has its lower portion, beneath pin 4, pivotally connected to the machine frame 1 by shaft pin 5. The grip lever 3 extends rearwardly of the frame from pins 4 and 5.

A handle 6 is integrally attached to and extends rearwardly of the machine frame 1. Handle 6 extends above grip lever 3. A spring 8 is interposed under tension between the pin 4 and a stopper 7, which is embedded in the inside wall of the handle 6. Spring 8 normally biases the grip lever 3 clockwise about the shaft pin 5 to open the lever 3. When the grip lever 3 is gripped toward and released to pivot away from the handle 6, the yokes 2 rock about the shaft pin 5.

Stopper 9 is fixedly positioned on frame 1 to determine the upper limit of the rocking motions of the yokes 2 under the bias of spring 8. The stopper 9 holds the yokes 2 and grip lever 3 in their stationary positions.

There is a drive element, ratchet lever 10, which has an upper end that is pivotally connected to the side of yokes 2 at a position quite far apart from the pivot pin 5. Pin 5 is at the bottom of yoke 2 and the ratchet lever is pivotally connected at the top of the yokes 2, which enlarges the distance between pivot 5 and the connection to ratchet lever 10. There is a curvilinear pawl portion at the lower end of the ratchet lever 10. The pawl portion is biased into meshing engagement with the correspondingly shaped ratchets or teeth of the drivable element, ratchet wheel 11, by the action of a spring 12. One end of the spring 12 seats on frame 1 while its other end presses on lever 10. The ratchet lever pawl portion and the ratchets of wheel 11 are so shaped that wheel 11 may be rotated counterclockwise by ratchet lever 10, as that lever rises or translates with yokes 2, but the ratchet lever slides past the teeth of wheel 11 as lever 10 descends with the yokes.

Figure 2:
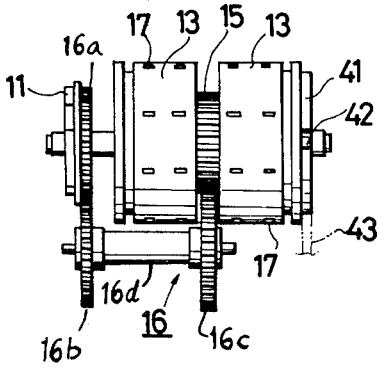
FIG. 2 is a top plan view of a feed wheel and a drive gear assembly of the label feed mechanism.
Figure 3:
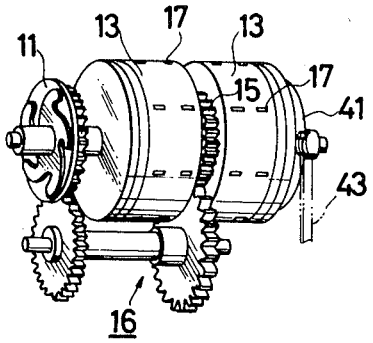
FIG. 3 is a perspective view showing the feed wheel and the drive gear assembly of FIG. 2.
Figure 4:
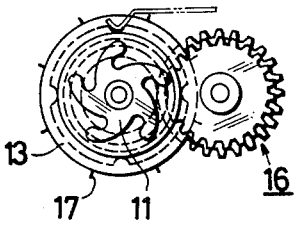
FIG. 4 is a side elevational view showing the feed wheel and the drive gear assembly of FIG. 2.

Turning to FIGS. 2 to 4, the ratchet wheel 11 is pivotally supported on a shaft 14. Feed wheels 13 and 13 are also pivotally supported on shaft 14. A driven gear 15 is secured to feed wheels 13 on shaft 14. A drive gear assembly 16 is interposed between the ratchet wheel 11 and the coacting driven gear 15. The drive gear assembly 16 includes a gear 16*a* which is integrally attached to the ratchet wheel 11. The gear assembly 16 includes two spaced apart gears 16*b* and 16*c* that mesh with the gear 16*a* and the coacting driven gear 15, respectively. The shaft 16*d* joins gears 16*b* and 16*c* to move together. As a result, the rotational motion of the ratchet wheel 11 is converted into corresponding rotation of the feed wheels 13 and 13.

In the embodiment of FIG. 1, the angular spacing between the adjacent pawls of the ratchet wheel 11 is 72° and the ratchet wheel 11 is rotated 72°, i.e., one tooth of the ratchet wheel, by each upward motion of the ratchet lever 10 in response to the rocking motions of the yokes 2 following a single gripping motion of the grip lever 3. The gear ratio between the gears 16*a* and 16*b*, on the one hand and between gears 16*c* and 15, on the other hand, are selected such that the feed wheels 13 and 13 rotate through a 90° angle for the 72° rotation of the ratchet wheel 11.

The feed wheels 13 and 13 have a plurality of transverse rows of advancing teeth 17 on their outer peripheries. Each row of teeth is angularly spaced 45° from the adjacent row.

Figure 5:
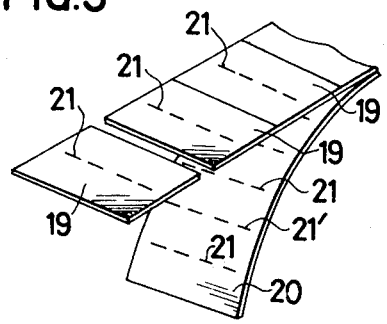
FIG. 5 is a perspective view showing one example of a continuous label strip to be fed through the portable labeling machine.

A roll 18 comprised of a continuous strip of labels is unwound into the portable labeling machine. One example of the continuous label strip 18 is shown in FIG. 5. It comprises a plurality of labels 19. Adhesive is applied to the backs of the labels. The labels are adhered in end-to-end relationship to a continuous strip of backing paper. A parting or peeling agent, such as silicone, has been applied to the backing strip to facilitate peeling of the adhered labels. Each of the labels 19 has a plurality of transverse cuts 21 therein arranged in a row. The cuts are positioned on the transverse center line of a label and extend through the labels 19 and the backing paper strip 20. Also, a plurality of transversely extending rows of cuts 21′ are formed through the backing paper strip 20 and are positioned at the space between the ends of the two adjacent labels 19. The spacing between any two adjacent rows of the cuts 21 and 21′ equals the spacing between any two adjacent rows of the advancing teeth 17 of the feed wheels 13 and 13 such that the cuts 21 and 21′ may be engaged by the advancing teeth 17.

To complete the description of a labeling machine in which the above described feeding mechanism is located, the labeling machine has the following additional features.

Returning to FIG. 1, a pair of upper and lower guides 22 and 23 are arranged above and below the feed wheels 13 and 13. Guides 22 and 23 are shaped and positioned to ensure firm engagement between the cuts 21 and 21′ in the continuous label strip 18 and the advancing teeth 17 of the feed wheels 13 and 13. The leading, forward (left hand) end of the upper guide 22 is pivotally connected to the machine frame 1 by shaft 24. The other end of guide 22 is equipped with a roller 25 which is positioned to and is operative to change the direction of the continuous label strip 18. The upper guide 22 is rotatable counterclockwise about the shaft 24 to enable insertion of the continuous label strip 18 between the outer periphery of the feed wheels 13 and 13 and the upper guide 22. The lower guide 23 is immovably secured to a bottom cover 26 of the labeling machine.

There is a peeling mechanism 27 of a type known in the art for successively peeling the labels 19 from the backing paper strip 20. This peeling mechanism 27 includes a platen 29 which extends forward from the front portion of the feed wheels 13 and 13. The continuous label strip 18 is mover over the upper surface of the platen 29. The platen 29 is adapted to receive and oppose the printing surface of a printing head 28*a* of a printing mechanism 28 which is clamped between the yokes 2. There is a label receiving base 30 which extends rearwardly from the front of the platen 29 and is located beneath the lower surface of the platen. A narrow space is left between platen 29 and base 30. The peeling mechanism 27 further comprises an upper label guide 31 having a lower surface, which covers the upper surface of the label receiving base 30 and the upper surface of the platen 29 and which is spaced from the platen 29, thereby to define a passage for the continuous label strip 18.

The label strip 18 passes over a label guide roller 32 and around the direction changing roller 25 to the feed wheels 13 and 13. The label strip 18 contacts the upper periphery of the feed wheels 13 and 13 in a manner such that the cuts 21 and 21' in the label strip are engaged by the advancing teeth 17. The label strip 18 is then advanced past the upper guide 22 and the guide 31 by wheels 13 and 13 to the peeling mechanism 27. At peeling mechanism 27, the backing paper strip 20 is reversed in its direction, passes through base 30 and runs over guide rollers 33 to the clearance space between the lower periphery of the feed wheels 13 and 13 and the fixed lower guide 23. The upper surface of lower guide 23 is matingly curved to wheels 13 and 13. The cuts 21 and 21' in the backing paper strip 20 are engaged by the advancing teeth 17 at the lower sides of wheels 13 and 13 and the backing strip is moved to the outside of the frame 1.

The labels are not reversed in their direction of travel but continue past platen 29. A label pressing member 34 applies peeled label 19 to an article positioned beneath the pressing member after the label 19 has been peeled off the backing paper strip 20 of the continuous label strip 18 by the peeling mechanism 27.

An inking roller 35 applies ink to the printing surface of the inking mechanism 28. There is a holding frame 36, which is pivotally connected at one end to a drive arm 38 and is urged upwardly to pivot counterclockwise by the action of a spring 37. The inking roller 35 is carried on supporting frame 36 and the roller is thus biased against printing head 28*a* by spring 37. The upper portion of the drive arm 38 is pivotally connected to the machine frame 1. The upper surface of arm 38 is formed into a cam 39 which extends rearwardly and has a slight downward, rearward incline in its condition shown in FIG. 1. The cam 39 is engaged by a roller 40 which is attached to the forward edge of the yokes 2. When the yokes 2 pivot counterclockwise upon gripping of hand lever 3, the roller 40 presses down on cam 39. This pivots the drive arm 38 forwardly or clockwise as the roller 40 rolls along cam 39 over substantially the full length of the cam. Forward motion of drive arm 38 moves the inking roller 35 forward so that ink is applied to the printing surface of the printing mechanism 28.

Continued gripping of the grip lever 3 brings the printing surface of the printing head 28*a* against the label then on platen 29.

In FIGS. 2 and 3, a retaining disc 41 is secured to that side surface of one of the feed wheels 13 that is away from gear 11. Retaining disc 41 has a plurality of grooves 42 formed on its outer periphery. These are arranged at equal angular intervals around disc 41. A retaining member 43 is supported to seat in the one of the grooves 42 then adjacent to member 43 so as to eliminate backlash of the feed wheels 13 and 13.

Figure 6:
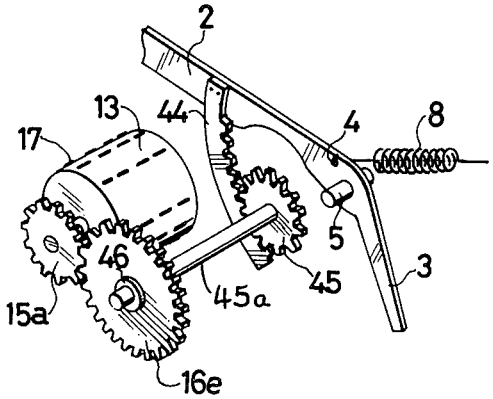
FIG. 6 is a perspective view showing another embodiment of the label feed mechanism according to the invention.

FIG.6 shows another embodiment of the label feed mechanism. Except for those elements specifically described below, the remainder of the labeling machine has the same elements as in the first embodiment. The ratchet lever 10 of the first embodiment is replaced by a toothed rack 44 (arcuately shaped), which is affixed to or is integral with the yokes 2 and which depends from the yokes. A pinion 45 meshes with the rack 44. This pinion 45 is supported on an axis 45*a* and the axis is rotatable with pinion 45. A drive gear 16*e* is carried on the same axis 45*a*. Gear 16*e* has a built in one-way clutch 46 operable so that the gear 16*e* may be rotated by axis 45*a* only in one direction (clockwise in FIG. 6).

When the grip lever 3 is gripped, the yokes 2 rock counterclockwise about the shaft pin 5. This shifts the rack 44 to rotate the pinion 45 counterclockwise in FIG. 6. The drive gear 16*e* is held against rotation by the one-way clutch 46 while the pinion rotates counterclockwise.

When the grip lever 3 is released, the yokes 2 are returned to their original position by spring 8, and the rack 44 rotates both the pinion 45 and the gear 16*e* clockwise in FIG. 6, as such rotation is permitted by the one-way clutch 46. The coacting driven gear 15*a* which meshes with gear 16*e* is rotated counterclockwise. The feed wheel 13 integrally connected with the coacting gear 15*a* is thus turned counterclockwise, and this effects the feeding of the continuous label strip 18.

In the second embodiment, the angle through which feed wheels 13 rotate is governed by the size of pinion 45 as compared to the total path traveled by rack 44, i.e., their gear ratio, on the one hand, and the gear ratio of gear 16*e* and 15*a*, on the other hand. Appropriate selection of these relationships can ensure that a particular angular motion of rack 44 will produce, for instance, 90° rotation of wheels 13.

In both of the above described embodiments, the yokes 2 are rocked up and down by the gripping and releasing of the grip lever 3. The drive gear assembly 16 or 16*e* is driven by the drive member, ratchet lever 10 or rack 44, which is supported on the yokes 2. The rotation of the drive gear assembly is further transmitted to the feed wheels 13 by the coacting driven gear 15 or 15*a*.

The grip lever 3 is normally held in a position such that the handle 6 can be easily grasped together with the grip lever, e.g., the lever 3 turns away from handle 6 by about 18°. Upon return of lever 3, the yokes 2 turn counterclockwise so that the ratchet lever which is pivotally attached to the yokes 2 or the rack 44 affixed to the yokes, may rotate the ratchet wheel 11 or the pinion 45, respectively, by about 72°. The drive gear 16*c* or 16*e* is driven by the ratchet wheel 11 or pinion 45 to drive the coacting gear 15, which is secured integrally to the feed wheels and the gear 15 is of a size to rotate the feed wheels 13 by 90°.

The feed wheels 13 rotate through a relatively large angular pathway as a result of a relatively small angular motion of grip lever 13. Thus, a continuous label strip comprised of relative large labels can be advanced a predetermined angle, by motion of a grip lever through which is the most suitable for manual gripping operation, without having to widen the gripping angle of the grip lever. The angle of rotation of the feed wheels 13 can be relatively large, as contrasted with the limited distance range through which the yokes 2 are rocked up and down.

In order that the operating torque of the grip lever 3 can be minimized, the drive member, such as the ratchet lever 10 or the rack 44 is connected to the yokes 2 in a position far from the pivot point of the yokes.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. A portable labeling machine comprising:

a frame; means for supporting and dispensing a continuous strip of labels; said frame including a passage therethrough having an entrance positioned to receive a strip of labels dispensed from said supporting means therefor; said passage extending through said frame and being adapted for having a label strip pass through said passage;

a label strip feed mechanism is said frame comprising:

a first axis on said frame; a feed wheel mounted on said first axis for rotation around said first axis; said feed wheel having a periphery; said feed wheel being located so that said periphery engages and moves said strip of labels along and through said passage as said feed wheel rotates;

a drivable element; a second rotation axis carried on said frame; said drivable element being mounted on and being rotatable on said second axis;

a drive gear assembly joining and in engagement with said drivable element and with said feed wheel such that rotation of said drivable element rotates said feed wheel;

a third pivot on said frame; a lever pivotally attached to said frame at said third pivot; said lever being pivotable around said third pivot between a first and a second position of said lever;

a fourth pivot on said frame; a yoke pivotally supported on said fourth pivot; said yoke being connected to said lever such that said yoke is pivotable between a third and a fourth position as said lever pivots between said first and second positions, respectively;

a drive element connected to said yoke and movable therewith; said drive element being connected to said yoke at a location spaced away from said fourth pivot, thereby to permit translational motion of said drive element upon pivoting of said yoke; said drive element engaging said drivable element such that movement of said yoke causes said drive element to rotate said drivable element, and thereby to rotate said feed wheel through said drive gear assembly; the motion of said drive element that is caused by motion of said yoke between said third and fourth positions rotates said drivable element through a first angular distance;

said gear assembly including engaging gears shaped and dimensioned to create a gear ratio among them such that said feed wheel is rotated through a second angular distance, which is greater than said first angular distance, by movement of said yoke between said third and fourth positions.

2. The portable labeling machine of claim 1, wherein said feed wheel has a plurality of label strip engaging teeth arrayed around its said periphery.

3. The portable labeling machine of claim 1, further comprising one-way rotation means associated with said drivable element and said feed wheel for enabling said feed wheel to rotate upon movement of said yoke to said fourth position and prohibiting rotation of said feed wheel upon movement of said yoke to said third position.

4. The portable labeling machine is claim 3, wherein said drive element comprises a ratchet arm attached to said yoke; said ratchet arm including a pawl engageable with said drivable element;

said drivable element comprising a ratchet wheel, having a series of angularly spaced pawl engaging ratchets arrayed around said ratchet wheel.

5. The portable labeling machine of claim 4, wherein said one-way rotation means comprises the shaping of said pawl and of said ratchets such that they engage only upon motion of said yoke in said fourth direction; biasing means for urging said ratchet arm into such engagement.

6. The portable labeling machine of claim 3, wherein said drive element comprises a toothed rack having teeth arrayed therealong; said rack being attached to said yoke; said drivable element comprising a correspondingly toothed pinion in engagement with said teeth of said rack and said pinion being rotatable by motion of said rack.

7. The portable labeling machine of claim 3, wherein said one-way rotation means comprises a one-way clutch in engagement with said drive gear assembly, for permitting rotation thereof only upon motion of said yoke to its said fourth position.

8. The portable labeling machine of claim 3, further comprising a print head in said frame, said print head including printable type; said print head being connected to said yoke for movement of said type by means of motion of said yoke into and out of said passage;

means supported in said frame for applying labels to an article; means for separating labels from a strip thereof also being supported in said frame and being located adjacent said passage.

9. The portable labeling machine of claim 8, further comprising an inking means connected to said yoke and movable by said yoke to engage and ink said type.

* * * * *